United States Patent [19]

Manon

[11] Patent Number: 4,648,226

[45] Date of Patent: Mar. 10, 1987

[54] GLASS ELEMENT, NOTABLY GLASS BLOCK OR TILE

[76] Inventor: Gérard Manon, 2, rue Notre-Dame, 54740 Ormes, France

[21] Appl. No.: 555,953

[22] Filed: Nov. 29, 1983

[30] Foreign Application Priority Data

Mar. 9, 1983 [FR] France ..... 83 03982

[51] Int. Cl.[4] ..... E04C 1/42

[52] U.S. Cl. ..... 52/308; 446/105; 52/574; 52/593; 52/779; 52/780

[58] Field of Search ..... 52/235, 293, 306, 307, 52/308, 436–439, 561, 562, 568–572, 589–604, 606, 608–612, 578, 584, DIG. 2, 574, 779, 780; 446/105, 108, 125, 127

[56] References Cited

U.S. PATENT DOCUMENTS

| | | | |
|---|---|---|---|
| Re. 18,349 | 2/1932 | Lapof | 52/569 |
| 250,635 | 12/1881 | McLean | 52/306 |
| 773,647 | 11/1904 | Kidder | 52/606 |
| 940,227 | 11/1909 | Benas | 52/594 |
| 1,109,348 | 9/1914 | McNerney | 446/105 |
| 1,212,417 | 1/1917 | Straight | 52/436 |
| 1,242,273 | 10/1917 | Thurman | 446/105 |
| 1,286,462 | 12/1918 | Wesche | 446/105 |
| 2,281,524 | 4/1942 | Meyers | 52/306 |
| 2,291,712 | 8/1942 | Hatton | 52/594 |
| 2,724,260 | 11/1955 | D'Eustachio | 52/306 |
| 3,286,423 | 11/1966 | Donlon | 52/591 |
| 3,352,541 | 11/1967 | Thom | 256/21 |
| 3,422,588 | 1/1969 | Stewart, Jr. | 446/125 |
| 3,456,413 | 7/1969 | Fischer | 52/591 |
| 3,818,656 | 6/1974 | Vigliotti | 52/594 |
| 4,058,943 | 11/1977 | Sturgill | 52/307 |
| 4,341,050 | 7/1982 | Long | 52/589 |

FOREIGN PATENT DOCUMENTS

| | | | |
|---|---|---|---|
| 507328 | 12/1951 | Belgium | 446/127 |
| 538793 | 6/1955 | Belgium | 52/593 |
| 547530 | 5/1956 | Belgium | 52/415 |
| 622414 | 11/1935 | Fed. Rep. of Germany | 52/DIG. 2 |
| 1093073 | 11/1960 | Fed. Rep. of Germany | 52/594 |
| 2502385 | 7/1976 | Fed. Rep. of Germany | 52/594 |
| 1401279 | 12/1965 | France | 52/306 |
| 2425875 | 1/1980 | France | 446/125 |

*Primary Examiner*—John E. Murtagh
*Assistant Examiner*—Andrew Joseph Rudy
*Attorney, Agent, or Firm*—Darby & Darby

[57] ABSTRACT

This glass element consists of a glass block, brick or tile which can be used for constructing panels, walls, slabs and the like. Each glass element comprises on its outer periphery interfitting means such as ribs and grooves and/or tongues and grooves adapted to engage corresponding interfitting means formed either on the adjacent glass block to tile, or on a vertical and/or horizontal independent frame; holes are formed in the end portions of the element for engagement by anchoring studs; the arrangement is such that the panels, walls, slabs and the like can be constructed without using mortar or reinforcing means.

6 Claims, 7 Drawing Figures

FIG. 1
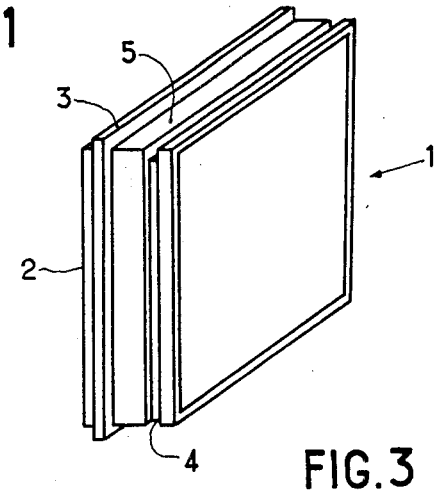
FIG. 2
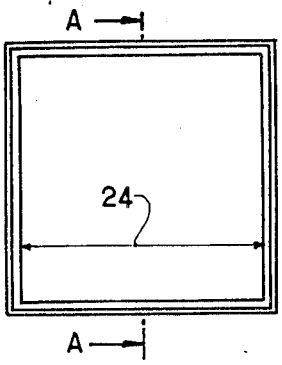
FIG. 3
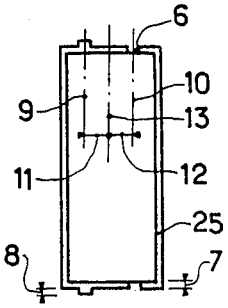
FIG. 4
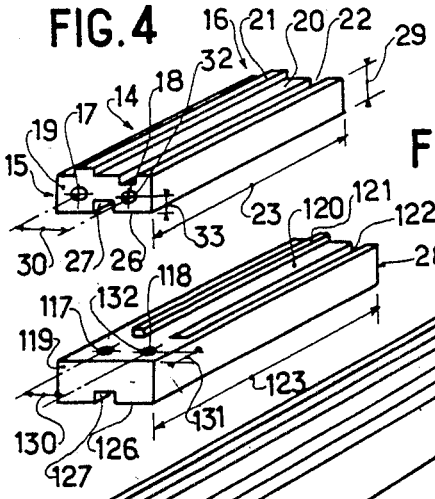
FIG. 5
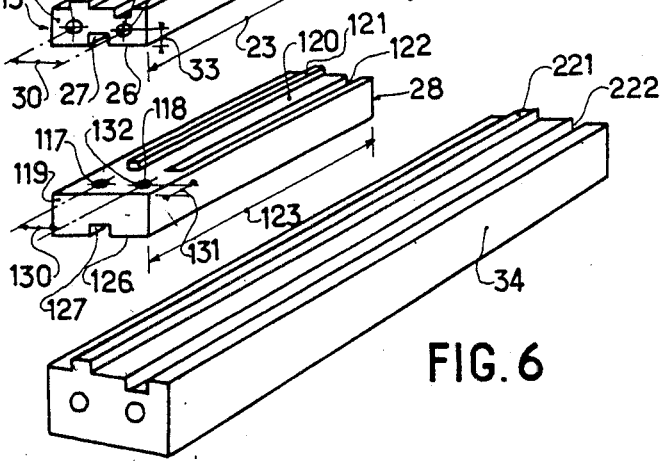
FIG. 6
FIG. 7
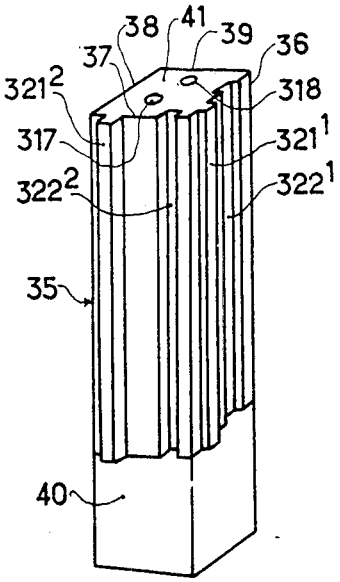

GLASS ELEMENT, NOTABLY GLASS BLOCK OR TILE

BACKGROUND OF THE INVENTION

The invention relates to a glass element, notably a glass block or tile, and also to a panel, wall, slab and the like constructed by using glass blocks of this type.

It is known to use colored or transparent or translucent glass blocks in the construction of walls, panels, slabs and the like. However, glass is fragile and cannot undergo any plastic deformation at room temperature. Walls are liable to undergo a certain degree of distortion in case of settling and the distortions thus transmitted to the glass block panel may develop accumulative stress such as to eventually break the glass blocks in relatively high proportions. It is therefore necessary to provide movement joints both vertically and horizontally between the main walls and the panels made of glass blocks. Under these conditions, the panel sizes are limited by possible distortions of the main walls and also by the difficulty of making said movement joints consisting essentially of a flexible mastic compound.

Furthermore, glass brick panels must have a good resistance to external forces and weather conditions. For this purpose, one or a plurality of wall-ties or irons, according to the block thickness, are interposed between each pair of adjacent vertical and horizontal rows of glass blocks. These wall-ties are embedded in the mortar constituting the joint between the glass blocks.

THE PRIOR ART

It is already known, notably through document FR-A No.-2,447,353, to provide glass blocks or bricks consisting each of two half-bats assembled by welding, each half-bat consisting of a pressed dished body having a front face and side faces. The end edge of the side faces constitutes the welding lip permitting of assembling the two half-bats. This document also teaches the use of an intermediate element of pressed glass disposed between the welding lips of the two half-bats. The periphery of this intermediate element is somewhat recessed in relation to the periphery of the external half-bats, so that more room is available for the metal wall-ties embedded in the concrete joint.

However, skilled workmen are necessary for constructing panels of this type, so that the final cost is increased unduly. This inconvenience is enhanced by the fact that the next course cannot be laid until the mortar of the lower joint has set.

SUMMARY OF THE INVENTION

It is the primary object of the present invention to avoid the inconveniences set forth hereinabove by providing a glass block or brick whereby panels, walls, slabs and the like can be constructed without resorting to any reinforcement or skilled workmen, the various mortar joints being provided not for reinforcing the assembly but only for enhancing the aesthetic appearance of the thus constructed panel, wall, slab and the like.

For this purpose, the present invention provides a glass element, notably a glass block, brick or tile, characterized by the fact that it comprises along its outer periphery interfitting means adapted to cooperate with matching interfitting means provided either on the adjacent block, brick or tile, or on a vertical and/or horizontal independence frame.

The advantages deriving from this invention lie essentially in the fact that the panels walls, slabs and the like can be constructed very rapidly by simply fitting the glass elements with one another, without resorting to the conventional practice of using cements, aggregates, reinforcements and water. On the other hand, it is possible to assemble these elements on the building site, thus dispensing with the metal frames and like ironmongery for protecting the panels and absorbing the efforts due to transport conditions and also to the fitting in case of prefabricated panels. Moreover, when glass blocks or bricks are used as decorative elements it is possible to change the design during the assembling operation since the various component element of the panels can be delivered separately.

THE DRAWING

FIG. 1 is a perspective view of a glass block or brick according to the present invention;

FIG. 2 is a front elevational view of the same block;

FIG. 3 is a section taken along the line A—A of FIG. 2;

FIG. 4 is a perspective view of an intermediate element;

FIG. 5 is a perspective view of a base element;

FIG. 6 is a perspective view of an element adapted to constitute a lintel, and

FIG. 7 is a perspective view of a post element having two adjacent sides provided with interfitting means.

DESCRIPTION OF THE PREFERRED EMBODIMENTS

Referring first to FIGS. 1, 2 and 3, the glass block or brick 1 comprises on its outer periphery 2 interfitting means 3, 4 which, when the glass elements are assembled in side by side or superposed relationship, cooperate with matching means provided on the adjacent block or blocks.

These interfitting means comprise on the one hand at least one peripheral rib 3 projecting from the surface 5 of the external periphery 2 and on the other hand at least one peripheral groove 4 having its bottom 6 somewhat recessed in relation to said surface 5. The depth 7 and width of this peripheral groove 4 are slightly greater than the height 8 and the width of the peripheral rib 3 to provide the space necessary for receiving, if necessary, a mortar having high-strength characteristics and consisting of synthetic resins. The cross-sectional contour of this peripheral groove 4 is consistent with that of the peripheral rib 3. Thus, and according to the basic principle of the invention, the rib 3 of a first glass block can engage the peripheral groove 4 of a second glass block and vice versa the peripheral rib 3 of the second glass block can engage the peripheral groove 4 of the first glass block.

For this purpose, the median plane 9 of peripheral rib 3 and the median plane 10 of peripheral groove 4 are equally spaced as denoted at 11, 12 from the median plane 13 of glass block 1. That is, as shown in FIG. 3, each side wall of the glass block has a rib 3 projecting from its surface on one side of the median plane of the glass block, and a recess or groove 4 formed on the opposite side of the median plane of the block. Thus, in profile and as illustrated in FIG. 3, the glass block has each of its side walls formed in three successive surface levels. Rib 3 and groove 4 define therebetween an intermediate level, central surface which can support an adjacent glass block. Of course, the basic principle of the invention is also applicable to glass blocks of any configuration, whether solid or hollow, translucent, or of any desired color, external appearance, thickness, whether plain-surfaced or provided with relief patterns or the like.

For constructing panels, walls and the like, the invention also provides an independence frame adapted to the specific characteristics of the glass block according to this invention.

This frame consists of intermediate elements 14 assembled in endto-end relationship to constitute either horizontal upper and lower cross members, or the posts of the frame (see FIG. 4). To this end, the ends 15, 16 of each intermediate element 14 comprise blind holes 17, 18 adapted to receive studs (not shown) for interconnecting or bonding two adjacent intermediate elements 14. These studs are longer than the depth of a hole 17 but slightly shorter than the sum of two depths of such orifices 17 of two intermediate elements 14 disposed end to end, so that the end faces 19 of these two intermediate elements 14 will properly seat and bear against each other, and that any play between these end faces 19 is safely eliminated.

One face 20, for example the top face, of said intermediate element 14 further comprises interfitting means consisting of a projecting tongue 21 with respect to said top face 20 and also of a groove 22 parallel to said projecting tongue 21. Of course, the width and height of said projecting tongue 21 correspond to the width and depth of said peripheral groove 4 of the glass block 1, and the width and depth of said groove 22 correspond to the width and height of the peripheral rib 3 of said glass block 1. Similarly, the distance between the projecting tongue 21 and groove 22 is the same as the distance between the peripheral rib 3 and the peripheral groove 4 of the glass block or brick or tile 1.

The length 23 of the intermediate element 14 is advantageously the same as the length 24 of the glass block or tile 1 (see FIG. 2).

According to a specific and advantageous form of embodiment of the invention, the glass block 1 comprises a square front face 25. Thus, the intermediate element 14 is the same for the horizontal courses and the columns or posts. The other face 26 of intermediate element 14 comprises a groove 27 for receiving a suitable compressible material.

Referring now to FIG. 5, illustrating a base element 28, the face 120 of this element comprises a projection tongue 121 and a parallel groove 122 identical with the projecting tongue 21 and parallel groove 22 of the intermediate element 14. Their lengths are also identical. However, the length 123 of this base element 28 is greater than the length 23 of the intermediate element 14 and corresponds to the sum of this length 23 and of the thickness 29 of said intermediate element 14. Two holes 117, 118 are formed in the top surface 120 of base element 28, the distance between centers 130 of these holes corresponding to that 30 of holes 17 and 18 of said intermediate element 14; besides, the distance 131 between the centers 132 and the end face 119 of base element 28 is identical with the height 33 between said centers 32 of holes 17, 18 and the lower face 26 of said intermediate element 14. The lower face 126 of base element 28 is also provided with a groove 127.

Reference will now be made to FIG. 6 illustrating an element adapted to constitute a lintel 34. The lintel structure is substantially the same as that of said intermediate element 14, except that the length of the lintel element 34 corresponds to the width of the aperture and its thickness is subordinate to the load to be supported by the lintel. According to the present invention, this lintel-forming element 34 also comprises a projecting tongue 221 and a parallel groove 222.

FIG. 7 illustrates a glass element adapted to constitute a post 35 interposed between two co-extensive panels or panels forming a corner between them, the angular relationship between the panels being not compulsorily 90 degrees. In fact, the post 35 has a polygonal cross-sectional contour with four, five, six or more faces 36, 37, 38, 39, .... At least two faces 36, 37 (not compulsorily adjacent to each other) comprise projecting tongues $321_1$, $321_2$, and grooves $322_1$, $322_2$. If necessary the lower section 40 is plain or suitably shaped to facilitate the sealing thereof in the floor or foundation. The top 41 (and possibly the bottom) is provided with holes 317, 318 to permit the stacking of several elements 35.

Though the present invention has been described with reference to a specific form of embodiment, it will readily occur to those conversant with the art that it should not be construed as being strictly limited thereby since many modifications may and changes be brought to the shapes, materials and combinations of these elements, without departing inasmuch from the basic principle of the invention.

What is claimed as new is:

1. A building element adapted to be interfitted with other building elements positioned adjacent thereto, which comprises:

a block formed of glass, the glass block having a median plane and including peripheral sidewalls, each of said sidewalls being formed in three successive surface levels, each sidewall including a rib projecting therefrom and situated on one side of the median plane of the block, a recess formed therein and situated on the opposite side of the median plane of the block, and an intermediate level, central support surface interposed between the rib and the recess for supporting an adjacent block thereon, each rib of each sidewall having equivalent dimensions and each recess formed in each sidewall having equivalent dimensions, each rib and recess of the glass block being dimensioned to be received by and to receive a corresponding recess and rib of an adjacent block.

2. A building element adapted to interfit with a frame structure, which comprises:

a block formed of glass, the glass block having a median plane and including peripheral sidewalls, each of said sidewalls being formed in three successive surface levels;

means for interfitting the block with the frame structure, the interfitting means being formed on each sidewall of the glass block and including a rib projecting from each sidewall and situated on one side of the median plane of the block, and a recessed surface defining a recess situated on the opposite side of the median plane of the block, each rib of each sidewall having the same dimensions and each recess formed in each sidewall having the same dimensions, the rib and recess being adapted to mate cooperatingly with a corresponding recess and rib formed on the frame structure; and means for supporting the block on the frame structure, the block supporting means including an intermediate level, central support surface interposed between the rib and the recess of each sidewall of the block and adapted to contact a corresponding surface of the frame structure.

3. A building element as defined by claim 2, wherein the depth of the recess formed in each sidewall of the glass block is less than the height of the corresponding rib of the frame structure, and wherein the height of the rib projecting from each sidewall of the glass block is less than the depth of the corresponding recess formed in the frame structure, the rib and recess of the glass block and the recess and rib of the frame structure respectively defining spaces therebetween to receive a mortar.

4. A building element as defined by claim 2, wherein the glass block has a planar configuration; and wherein the rib and recess of the glass block are formed equidistant from the median plane of the glass block.

5. In combination, a building element including a block of formed of glass, the glass block having a median plane and peripheral sidewalls, each of the sidewalls being formed in three successive surface levels;

a frame structure, the frame structure having first and second frame members, the first frame member being joined to the second frame member, each of the first and second frame members having an outside surface which is shaped to conform with a corresponding block sidewall; and first interfitting means formed in the sidewalls of the glass block for interfitting the block with the frame structure, and second interfitting means formed in the outside surface of each of the first and second frame members for interfitting the frame structure with the block, the first interfitting means including a rib projecting from each sidewall of the glass block and situated on one side of the median plane of the block, and a recessed surface defining a recess formed on each sidewall of the block and situated on the opposite side of the median plane of the block, each rib of each block sidewall having the same dimensions and each recess formed in each block sidewall having the same dimensions, the second interfitting means including a recessed surface defining a recess formed in the outside surface of each of the first and second frame members, and a rib projecting from the outside surface of each of the first and second frame members, the rib and recess of each of the first and second frame members being spaced apart a distance which corresponds to the spacing between corresponding ribs and recesses formed on the glass block, the ribs of the first and second frame members being dimensioned to be received by corresponding recesses of the glass block, and the ribs of the sidewalls of the glass block being dimensioned to be received by corresponding recesses of the first and second frame members.

6. The combination defined by claim 5, wherein the first frame member of the frame structure includes at least one hole formed in the outside surface thereof; and wherein the second frame member includes a lateral side, the lateral side having at least one hole formed therein.

* * * * *